United States Patent [19]

Hyodo et al.

[11] Patent Number: 4,582,415

[45] Date of Patent: Apr. 15, 1986

[54] APPARATUS FOR DETECTING THE REASONABLE CONDITION OF DEVELOPER IN A COPYING MACHINE

[75] Inventors: Keiichiro Hyodo, Kobe; Hiroshi Ishida, Ikoma; Jun Ueda, Osaka, all of Japan

[73] Assignee: Mita Industrial Co., Ltd., Osaka, Japan

[21] Appl. No.: 602,723

[22] Filed: Apr. 23, 1984

[30] Foreign Application Priority Data

May 11, 1983 [JP] Japan ..... 58-70375

[51] Int. Cl.[4] ..... G03G 15/00

[52] U.S. Cl. ..... 355/3 DD; 355/14 D; 118/689; 118/691

[58] Field of Search ..... 355/3 DD, 14 D; 118/688, 689, 690, 691

[56] References Cited

U.S. PATENT DOCUMENTS 4,168,901 9/1979 Ito et al. ..... 355/3 DD
4,273,843 6/1981 Fujita et al. ..... 355/3 DD
4,364,659 12/1982 Noda .

FOREIGN PATENT DOCUMENTS 3324544 1/1984 Fed. Rep. of Germany ... 355/14 D

*Primary Examiner*—A. C. Prescott
*Assistant Examiner*—David Warren
*Attorney, Agent, or Firm*—Wenderoth, Lind & Ponack

[57] ABSTRACT

The gap between a magnetic sensor and a fitting member supporting the magnetic sensor and the surface of the magnetic sensor are coated with thin nonmagnetic coating materials having small surface friction to prevent the developer from being introduced into the gap and adhered therein. Smooth flow of the developer is maintained, and the stable and accurate detection of the condition or ratio of the developer is ensured.

6 Claims, 4 Drawing Figures

APPARATUS FOR DETECTING THE REASONABLE CONDITION OF DEVELOPER IN A COPYING MACHINE

BACKGROUND OF THE INVENTION

1. Field of the Invention

The present invention relates to an improvement in an apparatus for detecting the desired or reasonable condition or ratio of developer in an electrostatic photographic copying machine, wherein changes in magnetic characteristics of the developer is detected by a magnetic sensor and the desired ratio of the developer is maintained on the basis of the detected result.

2. Description of the Prior Art

In a copying machine in which the developer consists of insulating substances or particles which are consumed and magnetic substances or particles, it is important to supply new insulating particles upon the consumption thereof to maintain the concentration of insulating particles within the desired ratio. Also, when the developer consists of only one component, it is important to supply new developer upon the consumption thereof to maintain the level thereof within a certain reasonable or desired condition or range.

In general, a coil has been used as the magnetic sensor for maintaining the reasonable condition of the developer, a change in the magnetic permeability of the developer being detected from a change in inductance of the coil thereby detecting the reasonable condition, i.e. the ratio or level, of the developer. In such case, it is necessary for the developer to flow over the surface of the magnetic sensor, and the conventional apparatus has the following disadvantages.

According to the conventional apparatus, as shown in FIG. 4, a magnetic sensor 15 is embedded in a fitting member 16, and a gap 18, though small, unavoidably is produced between magnetic sensor 15 and fitting member 16. As a result, developer 9 is introduced into gap 18 and adheres therein. The adhered developer 9 is gradually accumulated due to magnetic action thereof until at least a part of magnetic sensor 15 is covered with such developer 9. In particular, in the case, as shown in FIG. 4, when sensor 15 is arranged inwardly from a surface F of fitting member 16 to produce a step between the surface of sensor 15 and surface F of fitting member 16, developer 9 is even more apt to adhere to the surface of magnetic sensor 15 due to such step. This conventional apparatus has the disadvantage that the adhesion of developer 9 to the surface of magnetic sensor 15 leads to an insufficiently smooth flow of developer 9 on the surface of magnetic sensor 15, as a result of which the sensor is incapable of detecting the actual condition of the developer.

SUMMARY OF THE INVENTION

It is an object of the present invention to eliminate the above and other disadvantages inherent with the conventional apparatus and to provide a novel and practically useful apparatus for detecting the actual condition of the developer, by means of which the developer can be prevented surely from adhering to the surface of a magnetic sensor, and which is capable of always accurately detecting the true condition of the developer by a simple construction obtained by slightly improving the conventional apparatus.

BRIEF DESCRIPTION OF THE DRAWINGS

The drawings illustrate an apparatus for detecting the existence of a desired or reasonable condition of developer in a copying machine according to the present invention, and in which.

DESCRIPTION OF THE PREFERRED EMBODIMENT

Figure 1:
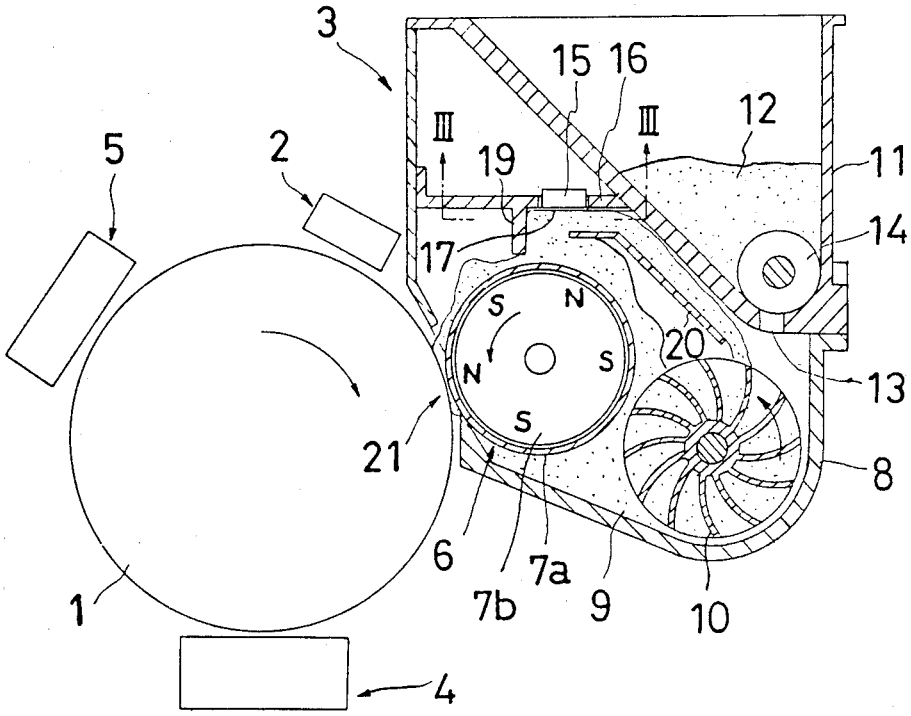
FIG. 1 is a longitudinal sectional view showing a detecting apparatus according to the present invention in place in a developer apparatus of a copying machine.
Figure 2:
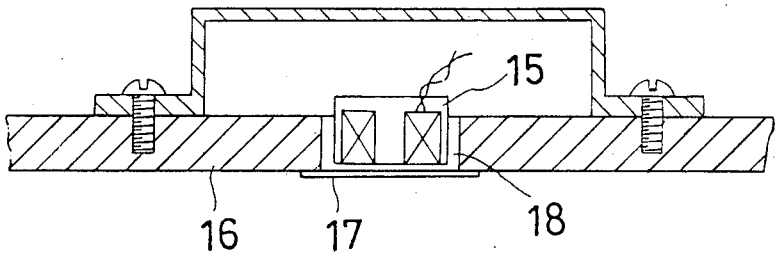
FIG. 2 is a longitudinal sectional view showing the principal parts of the detecting apparatus.
Figure 3:
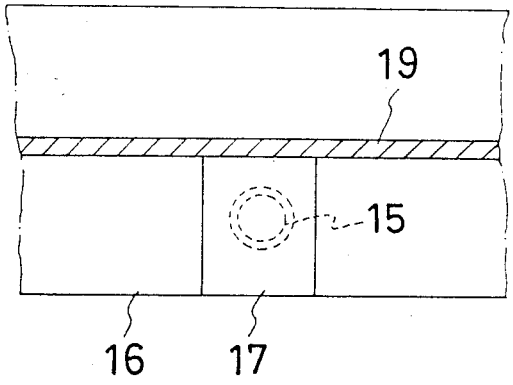
FIG. 3 is a sectional view taken along line III—III of FIG. 1.
Figure 4:
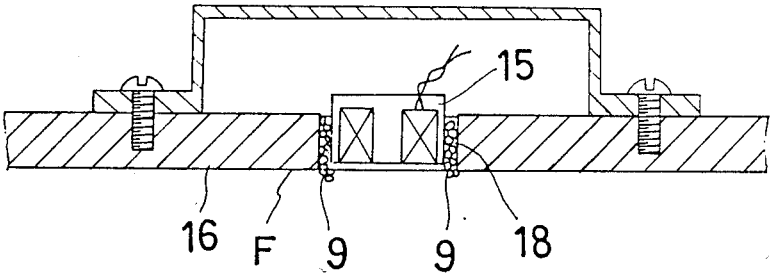
Fig.4 PRIOR ART
FIG. 4 is a longitudinal sectional view showing the conventional detecting apparatus.

The preferred embodiment of the present invention will be described below with reference to FIGS. 1 to 3. 1 designates a photoreceptor of a copying machine around which an electrifying means 2, a developing means 3, a transferring means 4, a cleaning means 5 and the like are arranged. 6 designates a magnetic brush forming means including a rotary developing sleeve *7a* and a magnet *7b* fixedly mounted inside rotary developing sleeve *7a* and forming the principal part of developing means 3. 8 designates a developing vessel or housing containing two-component developer consisting of magnetic substances or particles and insulating substances or particles, for example magnetic carriers and toners. Magnetic brush forming means 6 and a stirring roller 10 are rotatably fitted inside developing vessel 8. 11 designates a toner vessel containing toner 12 for supplying the toner and arranged over developing vessel 8 and opening into developing vessel 8 through an opening 13. A toner supplying roller 14 made of sponge is rotatably fitted at opening 13. 15 designates a magnetic sensor provided with a coil embedded in a fitting member 16 fixedly mounted extending from developing vessel 8 to toner vessel 11. Thin nonmagnetic coating material 17 having low surface friction is fixedly fitted on the surface of fitting member 16 so that the gap 18 formed between magnetic sensor 15 and fitting member 16 and the surface of magnetic sensor 15 are covered tightly with coating material 17. Thin films of resins having trade names of Mylar of Lumilar, various thin plates of aluminum, tin, copper, stainless steel or the like can be used as coating material 17. In addition, 19 designates a brush length-adjusting mechanism and 20 designates a partition plate.

The operation of such apparatus now will be described. Photoreceptor 1, developing sleeve *7a* and stirring roller 10 are rotated in the directions of the arrows shown in FIG. 1 upon activation of the copying machine. At this time, developer 9 is adhered to the circumferential surface of developing sleeve *7a* and carried thereon. Developer 9 then is transferred to a developing zone 21 where developing occurs. In general, the toner is used at a ratio of 5 to 20 parts by weight per 100 parts by weight magnetic carrier used. The condition or ratio of toner concentration is detected by means of magnetic sensor 15 and rotates toner-supplying roller 14 to supply more toner 12 if the quantity of toner in developer 9 is detected as being below such range, thereby maintaining the toner concentration within the optimum range. During this time, according to the present invention, since gap 18 between magnetic sensor 15 and fitting member 16 and the surface of magnetic sensor 15 are coated with coating material 17, in contrast with the conventional apparatus, developer 9 can be prevented from being introduced into gap 18 and adhered therein, and the smooth flow of developer 9 on the surface of magnetic sensor 15 is not hindered. Accordingly, it always is possible to carry out accurate detection and to maintain the optimum toner concentration or ratio.

In addition, although a magnetic brush is formed to rotate in the counterclockwise direction in the above described preferred embodiment, the magnetic brush may be formed to rotate in the clockwise direction and magnetid sensor 15 may be arranged in the area of feed of the developer to the brush forming means in the brush forming direction (i.e. below developing sleeve *7a*).

Furthermore, the level of developer 9 may be detected by means of magnetic sensor 15, and upon detection of a lower level limit requiring the supply of additional toner, sensor 15 may cause a display lamp indicative of the need for the supply of additional toner to be lighted or may cause the desired amount of toner to be supplied automatically. In addition, although two-component type developer was used in the above described preferred embodiment, it goes without saying that the present invention is applicable also when a one-component type developer is used.

As will be obvious from the above description, according to the present invention, since the gap between a magnetic sensor and a fitting member and the surface of the magnetic sensor are coated with thin nonmagnetic coating material having low surface friction, in contrast with the conventional apparatus, the developer can be prevented surely from being introduced into the gap, adhered therein, and gradually accumulated therein until it is adhered to at least a part of the surface of the magnetic sensor to hinder the smooth flow of the developer. Accordingly, the accurate detection of the condition or ratio of the developer is made possible merely by a slight structural improvement that the gap between the magnetic sensor and the fitting member and the surface of the magnetic sensor are coated with coating materials.

We claim:

1. In a developing apparatus for developing an image in a copying machine, said developing apparatus being of the type including a housing containing developer, magnetic brush forming means for forming a magnetic brush of developer for developing an image, and stirring means for supplying developer along a path to said brush forming means, the improvement of means for accurately and reliably detecting a change in a magnetic characteristic of said developer supplied along said path to said brush forming means, said detecting means comprising:

a magnetic sensor embedded in a fitting member, with a gap therebetween, and supported thereby at a position along said path, such that a surface of said magnetic sensor is directed toward said developer as said developer flows past said surface toward said brush forming means; and means for preventing said developer from entering said gap, accumulating therein and interfacing with the smooth flow of said developer past said surface, said preventing means comprising a thin coating of a nonmagnetic material covering said gap and said surface, said material having a low surface friction.

2. The improvement claimed in claim 1, wherein said developer is of the two component type including magnetic carrier particles and toner particles, and said magnetic sensor comprises means for detecting the toner concentration of said developer.

3. The improvement claimed in claim 2, further comprising means for supplying additional toner to said housing, said toner supplying means being operable by said magnetic sensor upon detection thereby that the toner concentration of said developer flowing thereby is below a predetermined value.

4. The improvement claimed in claim 1, wherein said developer is of the one component type.

5. The improvement claimed in claim 1, wherein said thin coating comprises a resin coating.

6. The improvement claimed in claim 1, wherein said thin coating comprises a thin plate of a metal such as aluminum, tin, copper or stainless steel.

* * * * *